US008292605B2

(12) United States Patent
Yuan et al.

(10) Patent No.: US 8,292,605 B2
(45) Date of Patent: Oct. 23, 2012

(54) ROTARY FLUID DEVICE WITH MULTI-LEVEL PHASE SHIFT CONTROL

(75) Inventors: QingHui Yuan, Osseo, MN (US); Brian S. R. Armstrong, Shorewood, WI (US)

(73) Assignee: Eaton Corporation, Cleveland, OH (US)

( * ) Notice: Subject to any disclaimer, the term of this patent is extended or adjusted under 35 U.S.C. 154(b) by 592 days.

(21) Appl. No.: 12/569,415

(22) Filed: Sep. 29, 2009

(65) Prior Publication Data

US 2010/0080721 A1 Apr. 1, 2010

Related U.S. Application Data

(60) Provisional application No. 61/101,306, filed on Sep. 30, 2008.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 15/00*** | (2006.01) |

(52) U.S. Cl. ..... 418/1; 418/61.3; 417/53

(58) Field of Classification Search ..... 418/1, 61.3, 418/166, 171; 417/53–55

See application file for complete search history.

(56) References Cited

U.S. PATENT DOCUMENTS

| | | | | |
|---|---|---|---|---|
| 3,516,765 | A * | 6/1970 | Boyadjieff et al. | 418/61.1 |
| 3,778,198 | A * | 12/1973 | Giversen | 418/61.3 |
| 3,779,673 | A | 12/1973 | Ahern et al. | |
| 4,493,622 | A * | 1/1985 | Miller | 418/61.3 |
| 4,767,292 | A | 8/1988 | Kinder | |
| 5,393,201 | A * | 2/1995 | Okutani et al. | 417/16 |
| 5,700,136 | A | 12/1997 | Sturman | |
| 6,884,048 | B2 * | 4/2005 | Petersen et al. | 418/61.3 |
| 2009/0123313 | A1 * | 5/2009 | Armstrong et al. | 418/1 |

FOREIGN PATENT DOCUMENTS

| | | |
|---|---|---|
| DE | 196 27 095 | 4/1997 |
| EP | 0 558 921 | 9/1993 |

OTHER PUBLICATIONS

U.S. Appl. No. 12/067,711—Armstrong et al.—Net-Displacement Control of Fluid Motors and Pumps—filed Sep. 21, 2006 also has the U.S. Patent Application Publication No. US 2009/0123313 A1 (Armstrong et al.) with Publication Date of May 14, 2009.*

* cited by examiner

*Primary Examiner* — Theresa Trieu
(74) *Attorney, Agent, or Firm* — Merchant & Gould P.C.

(57) ABSTRACT

A method for controlling a rotary fluid device includes providing a rotary fluid device having a fluid displacement assembly and a plurality of control valves. The fluid displacement assembly includes a first member and a second member. The first and second members have relative movement and define a plurality of volume chambers. The plurality of control valves is in fluid communication with the plurality of volume chambers. A desired displacement is received. A relative position of the first and second members is determined. An optimal displacement family is selected from a plurality of displacement families that is based on peak displacements of a plurality of displacement curves. A phase shift angle for the optimal displacement family is selected so that an actual displacement of the fluid displacement assembly approaches the desired displacement. The control valves of the rotary fluid device are actuated in accordance with the phase shift angle.

20 Claims, 12 Drawing Sheets

ROTARY FLUID DEVICE WITH MULTI-LEVEL PHASE SHIFT CONTROL

CROSS-REFERENCE TO RELATED APPLICATIONS

The present application claims priority to U.S. Provisional Patent Application Ser. No. 61/101,306, which is entitled "Multi-Level Phase Shift (MLPS) Control Enabled Variable Displacement Gerotor/Geroler" and was filed on Sep. 30, 2008. The present application is related to U.S. patent application Ser. No. 12/067,711, which is entitled "Net-Displacement Control of Fluid Motors and Pumps" and was filed on Sep. 21, 2006. The above identified disclosures are hereby incorporated by reference in their entirety.

BACKGROUND

Fixed displacement fluid devices (e.g., motors and pumps) utilize displacement mechanisms for various purposes. For example, fixed displacement motors use displacement mechanisms to convert fluid pressure into a rotary output while fixed displacement pumps used displacement mechanisms to output a given amount of fluid in response to rotation of the displacement mechanism. Such devices are used in a variety of commercial applications. As a fixed displacement fluid devices, the displacement mechanism cannot be directly adjust to increase or decrease the amount of fluid transferred through the fluid device during one complete rotation of the shaft.

Variations in the amount of fluid transferred through the fluid device can be achieved, however, through the use of hydraulic flow control valves or a variable fluid supply (e.g., a variable displacement pump). However, in some applications, the use of hydraulic flow control valves or variable fluid supplies result in decreased efficiencies and/or added mechanical complexity.

SUMMARY

An aspect of the present disclosure relates to a method for controlling a rotary fluid device. The method includes providing a rotary fluid device having a fluid displacement assembly and a plurality of control valves. The fluid displacement assembly includes a first member and a second member. The first and second members have relative movement and cooperatively define a plurality of volume chambers. The plurality of control valves is in fluid communication with the plurality of volume chambers. A desired displacement is received. A relative position of the second member to the first member of the fluid displacement assembly is determined. An optimal displacement family is selected from a plurality of displacement families that is based on peak displacements of a plurality of displacement curves. A phase shift angle for the optimal displacement family is selected so that an actual displacement of the fluid displacement assembly approaches the desired displacement. The control valves of the rotary fluid device are actuated in accordance with the phase shift angle.

Another aspect of the present disclosure relates to a method for controlling an electro-hydraulic system. The method includes providing an electro-hydraulic system having a rotary fluid device and an electronic control unit. The rotary fluid device includes a fluid displacement assembly and a plurality of control valves. The fluid displacement assembly has a first member and a second member. The first and second members have relative movement and cooperatively define a plurality of volume chambers. The plurality of control valves is in fluid communication with the volume chambers. The electronic control unit is in electrical communication with the plurality of control valves. A desired displacement is received. A relative position of the second member to the first member of the fluid displacement assembly is determined. An optimal displacement family is selected from a plurality of displacement families that is based on peak displacements of a plurality of displacement curves. A phase shift angle for the optimal displacement family is selected so that an actual displacement of the fluid displacement assembly approaches the desired displacement. An optimal valve configuration is selected based on the phase shift angle. The control valves of the rotary fluid device are actuated in accordance with the optimal valve configuration.

Another aspect of the present disclosure relates to a method for controlling a rotary fluid device. The method includes providing a rotary fluid device having a fluid displacement assembly and a plurality of control valves. The fluid displacement assembly includes a ring member and a star member. The ring and star members have relative movement and cooperatively define a plurality of volume chambers. The plurality of control valves is in fluid communication with the plurality of volume chambers. A desired displacement is received. A relative position of the star member to the ring member of the fluid displacement assembly is determined. An optimal displacement family is selected from a plurality of displacement families that is based on peak displacements of a plurality of displacement curves. The peak displacement of the optimal displacement family is greater than the desired displacement, which is greater than the peak displacement of an immediately preceding displacement family. An optimal zero displacement angle is located in the optimal displacement family. An optimal valve configuration based on the optimal zero displacement angle is selected. The control valves of the rotary fluid device are actuated in accordance with the optimal valve configuration.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
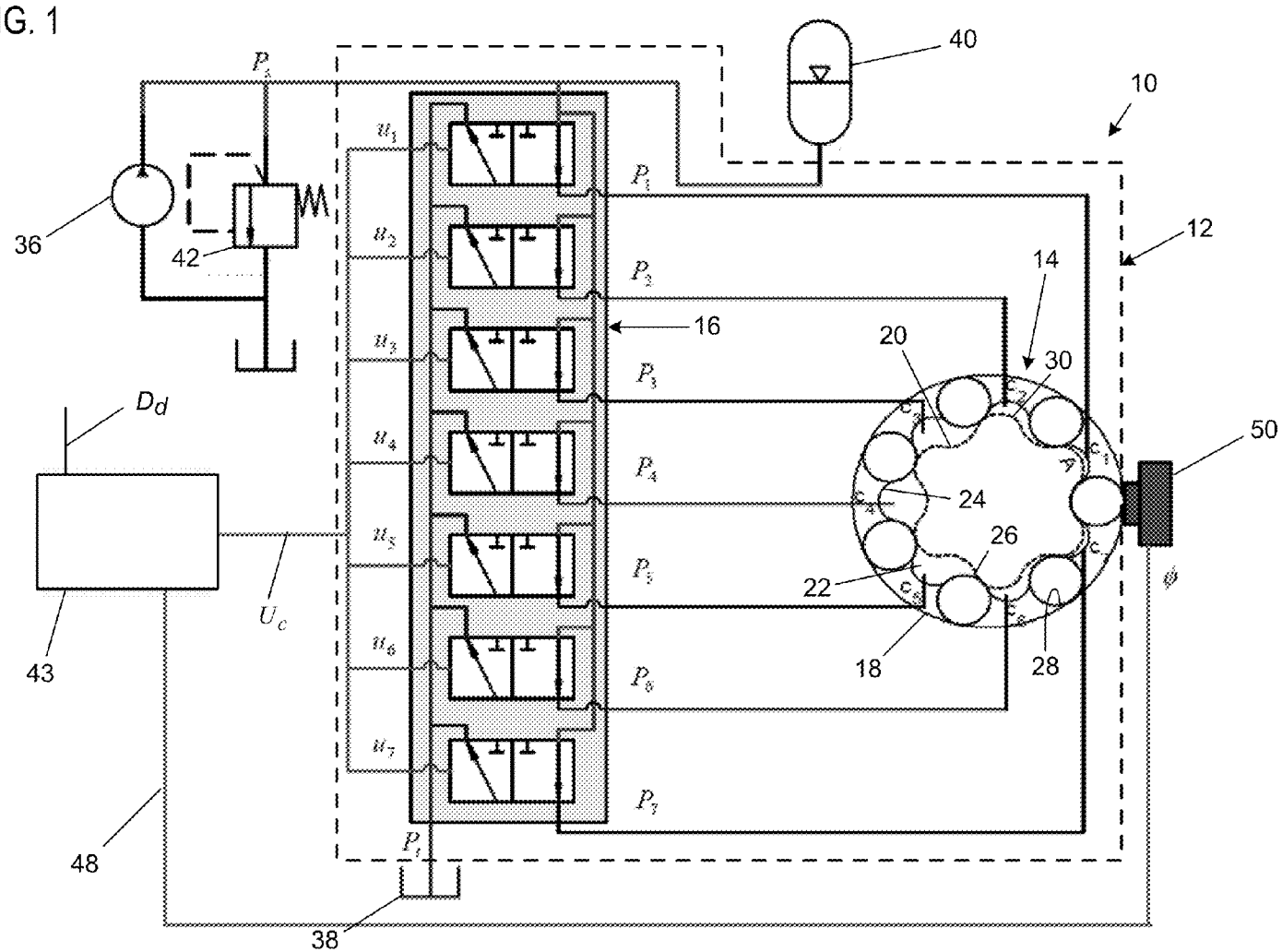
FIG. 1 is a schematic representation of an electro-hydraulic system having exemplary features of aspects in accordance with the principles of the present disclosure.

Referring now to FIG. 1, a schematic representation of an electro-hydraulic system, generally designated 10, is shown. The electro-hydraulic system 10 includes a rotary fluid device, generally designated 12. The rotary fluid device 12 includes a fluid displacement assembly 14 and a plurality of electrically actuated control valves 16. In the depicted embodiment of FIG. 1, and by way of example only, there are seven volume chambers 22 and seven control valves 16.

The fluid displacement assembly 14 includes a first member 18 and a second member 20. The first and second members 18, 20 cooperatively define a plurality of volume chambers 22. The plurality of volume chambers 22 is adapted to expand and contract as the second member 20 moves relative to the first member 18.

In one aspect of the present disclosure, the fluid displacement assembly 14 is a gerotor assembly. In another aspect of the present disclosure, the fluid displacement assembly 14 is a GEROLER® assembly. The first member 18 of the GEROLER® assembly 14 is a ring member. The ring member 18 defines a bore 24 that includes a plurality of internal lobes 26. In one aspect of the present disclosure, the plurality of internal lobes 26 is a plurality of rollers that rotate in generally semi-cylindrical openings 28 of the ring member 18. In the depicted embodiment of FIG. 1, and by way of example only, the ring member 18 includes seven rollers 26.

The second member 20 of the GEROLER® assembly 14 is a star member. The star member 20 is eccentrically disposed in the bore 24 of the ring member 18. The star member 20 includes a plurality of external teeth 30. In one aspect of the present disclosure, the number of external teeth 30 of the star member 20 is less then the number of rollers 26 of the ring member 18. In the depicted embodiment of FIG. 1, and by way of example only, the star member 20 includes six external teeth 30.

The star member 20 is adapted to orbit and rotate relative to the ring member 18. The relationship between a rotation angle of the star member 20 about its center and an orbit angle of the star member 20 about the center of the ring member 18 is given by the following equation 32:

$$\phi(t) = -\left(\frac{1}{N_2 - 1}\right) \times \beta(t), \tag{32}$$

where $\phi(t)$ is the rotation angle of the star member 20 about its center at sample time t, $N_2$ is the number of volume chambers 22, and $\beta(t)$ is the orbit angle of the star member 20 about the center of the ring member 18 at sample time t.

Figure 2:
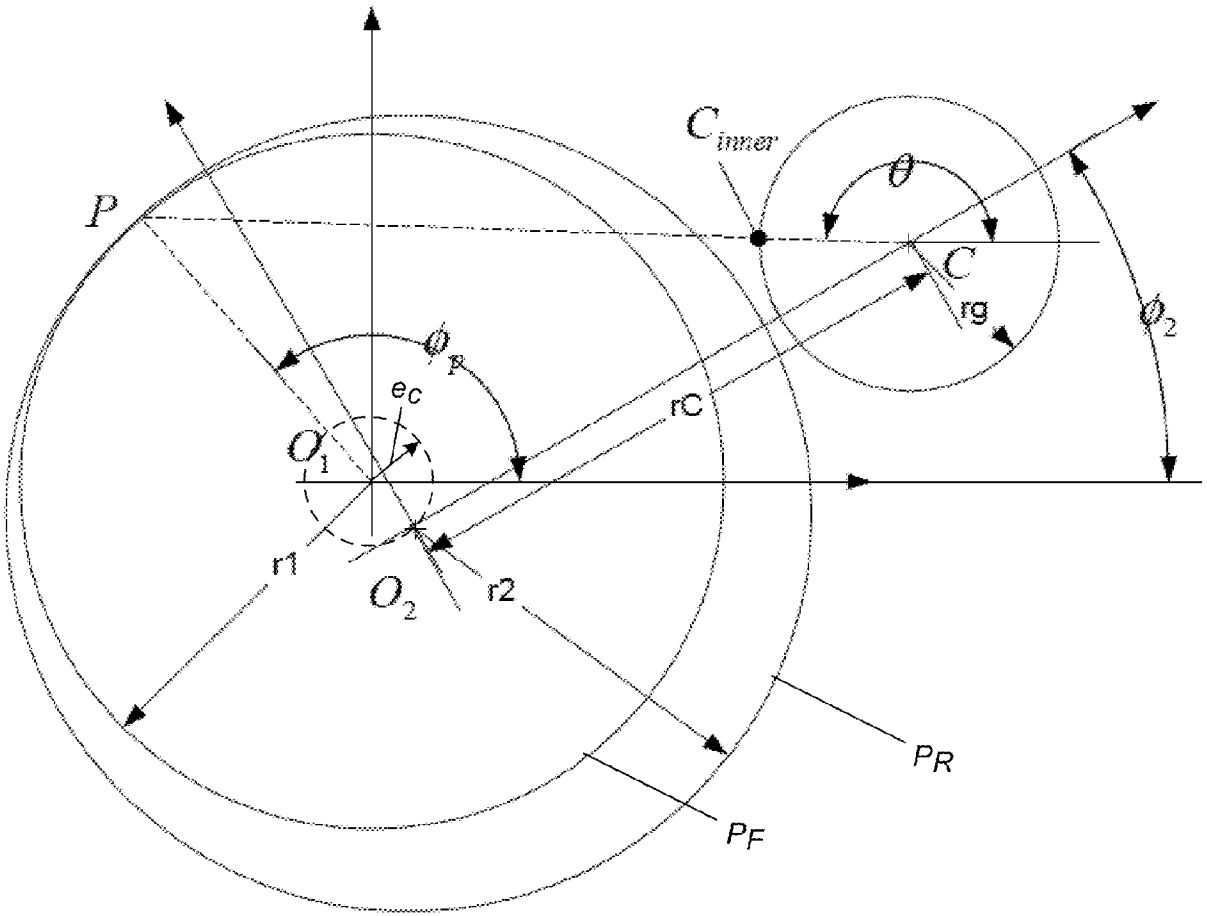
FIG. 2 is a schematic representation of the generation of an epitrochoidal path suitable for generating the profile of a star member of a fluid displacement assembly.

Referring now to FIG. 2, the generation for the profile of the star member 20 will be described. In one aspect of the present disclosure, the profile of the star member 20 is formed using an epitrochoid. An epitrochoid is defined by the path of a fixed point C that is attached to a rolling pitch circle $P_R$, which rolls on the outside of a fixed pitch circle $P_F$, where the rolling pitch circle $P_R$ and the fixed pitch circle $P_F$ are in internal tangency. The rolling pitch circle $P_R$ is larger than the fixed pitch circle $P_F$. The fixed pitch circle $P_F$ includes a center $O_1$ while the rolling pitch circle $P_R$ includes a center $O_2$. The fixed point C is disposed a distance $r_C$ from the center $O_2$ of the rolling pitch circle $P_R$.

An eccentricity $e_C$ of the fluid displacement assembly 14 is defined as the distance between the center $O_1$ of the fixed pitch circle $P_F$ and the center $O_2$ of the rolling pitch circle $P_R$. The eccentricity $e_C$ is calculated using the following equation 34:

$$e_C = r_2 - r_1, \tag{34}$$

where $r_1$, $r_2$ are the radii of the fixed and rolling pitch circles $P_F$, $P_R$, respectively.

Referring again to FIG. 1, the fluid displacement assembly 14 has a fixed displacement. As a fixed displacement assembly, the fluid displacement assembly 14 cannot be directly adjusted to increase or decrease the amount of fluid that is transferred through the fluid displacement assembly 14 during one complete rotation of the second member 20 relative to the first member 18.

Fluid is communicated to and from the volume chambers 22 of the fluid displacement assembly 14 through the control valves 16. In one aspect of the present disclosure, the selective actuation of each of the plurality of control valves 16 provides variable displacement functionality to the fluid displacement assembly 14. This variable displacement functionality allows for a variable amount of fluid to be transferred through the fluid displacement assembly 14 during one complete rotation of the second member 20 relative to the first member 18.

In the depicted embodiment of FIG. 1, each of the plurality of control valves 16 is a two-position, three-way valve, which is independently controllable. Each of the plurality of control valves 16 is electronically actuated to provide fluid communication between one of the volume chambers 22 and one of a fluid supply 36 and a fluid return 38. In one aspect of the present disclosure, the fluid supply 36 is a fluid pump while the fluid return 38 is a fluid reservoir or tank. In another aspect of the present disclosure, the fluid supply 36 is a fixed displacement supply.

The electro-hydraulic system 10 further includes an accumulator 40 and a relief valve 42. The accumulator 40 and the relief valve 42 are in fluid communication with the fluid supply 36. The accumulator 40 is adapted to reduce pressure fluctuations in the fluid from the fluid supply 36. The relief valve 42 is adapted to provide fluid communication between the fluid supply 36 and the fluid return 38 in the event the pressure of the fluid exceeds a predetermined limit.

The electro-hydraulic system 10 further includes an electronic control unit ("ECU") 43. The ECU 43 is adapted to control the actuation of the control valves 16. The ECU 43 outputs a valve configuration $U_c$ to the control valves 16 in response to a desired displacement $D_d$ (or torque) and a position input signal 48 received by the ECU 43. The position input signal 48 provides the relative rotation of the second member 20 with respect to the first member 18. In one aspect of the present disclosure, the position input signal 48 is provided by an encoder 50 that is disposed on a shaft of the rotary fluid device 12. The encoder 50 senses the rotation angle $\phi$ of the star member 20 of the fluid displacement assembly 14. Equation 32 can be used to determine the corresponding orbit angle $\beta$ of the star member 20.

The valve configuration $U_c$ provided by the ECU 43 is a multi-bit binary word that specifies whether each volume chamber 22 of the fluid displacement assembly 14 is in fluid communication with the fluid supply 36 or the fluid return 38. The valve configuration $U_c$ is provided as a vector (e.g., $U_c(t)=[u_1(t)\ u_2(t)\ \ldots\ u_{N_2}(t)]^T$, where $u_{j_c}(t)\epsilon\{0,1\}$).

At a specified rotation angle $\phi(t)$ of the star member 20, the fluid displacement assembly 14 outputs a torque. The torque output of the fluid displacement assembly 14 can be computed using the following torque equation 54:

$$T_m(\phi, t) = \sum_{j_c=1}^{N_2} P_{j_c}(t)\frac{dV_{j_c}(\phi)}{d\phi}, \tag{54}$$

where $N_2$ is the total number of volume chambers 22, $P_{j_c}(t)$ is the pressure [pascals] in the volume chamber $j_c$ at time t, and $$\frac{dV_{j_c}(\phi)}{d\phi}$$

is the incremental change of volume of chamber $j_c$ with respect to the incremental change of rotation angle $\phi(t)$ of the star member 20. As the volume chambers 22 are in fluid communication with one of the fluid supply 36 or the fluid return 38, there are two potential pressures in each volume chamber $j_c$ at time t. Those pressures are given by following pressure equation 56:

$$P_{j_c}(t) = \begin{cases} P_s & u_{j_c}(t) = 1 \\ P_t & u_{j_c}(t) = 0 \end{cases}, \tag{56}$$

where $P_s$ is the pressure of the fluid of the fluid supply 36, $P_t$ is the pressure of the fluid of the fluid return 38, $u_{j_c}(t)\epsilon\{0,1\}$ is the control signal to control valve 16 associated with volume chamber $j_c$. Equation 56 does not include the transient effects.

Using equations 54 and 56, instantaneous displacement D(t) of the fluid displacement assembly 14 is defined as:

$$D(\phi, U_c) = \frac{T_m(\phi, t)}{P_s} = \sum_{j_c=1}^{N_2} u_{j_c}\frac{dV_{j_c}(\phi)}{d\phi}. \tag{57}$$

Assuming a constant large supply pressure and a small tank pressure, the instantaneous displacement D(t) is proportional to the instantaneous torque $T_m$. As a result of this proportionality, the terms "displacement" and "torque" as used herein are interchangeable.

The instantaneous volume change rate $$\frac{dV_{j_c}(\phi)}{d\phi}$$

with respect to the inner gear angle for each chamber $j_c$ is given below with notation adapted to a fixed-ring coordinate frame:

$$\frac{dV_{j_c}(\phi)}{d\phi} = L_M r_2 r_C\left\{\cos\left(\beta - \frac{(j_c+1)2\pi}{N_2}\right) - \cos\left(\beta - \frac{j_c 2\pi}{N_2}\right)\right\} + L_M r_g\left\{\sqrt{r_2^2 + r_C^2 - 2r_2 r_C\cos\left(\beta - \frac{(j_c+1)2\pi}{N_2}\right)} - \sqrt{r_2^2 + r_C^2 - 2r_2 r_C\cos\left(\beta - \frac{j_c 2\pi}{N_2}\right)}\right\}, \tag{58}$$

where $L_M$ is thickness of the fluid displacement assembly 14, $r_g$ is the radius of a generating pin centered at point C in the epitrochoidal path, and $\beta$ is the orbit angle of the star member 20. It can be seen from equation 58 that the instantaneous volume change rate can be approximated as a sinusoidal curve if $r_g$ is relatively small compared to $r_2$ so that the second term in equation 58 can be neglected.

Figure 3:
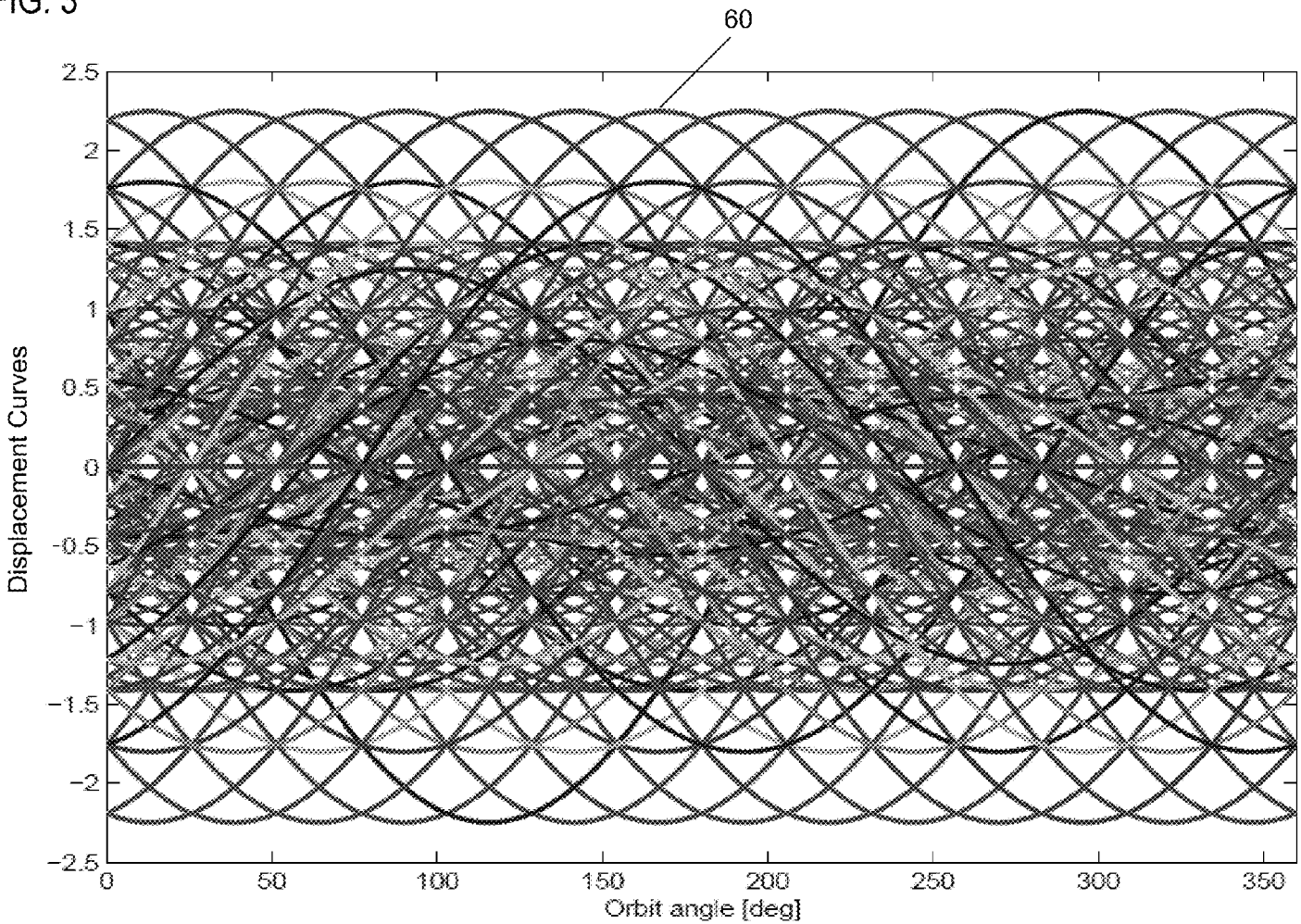
FIG. 3 is an exemplary plot of displacement curves of the fluid displacement assembly versus the orbit angle of the star member.
Figure 4:
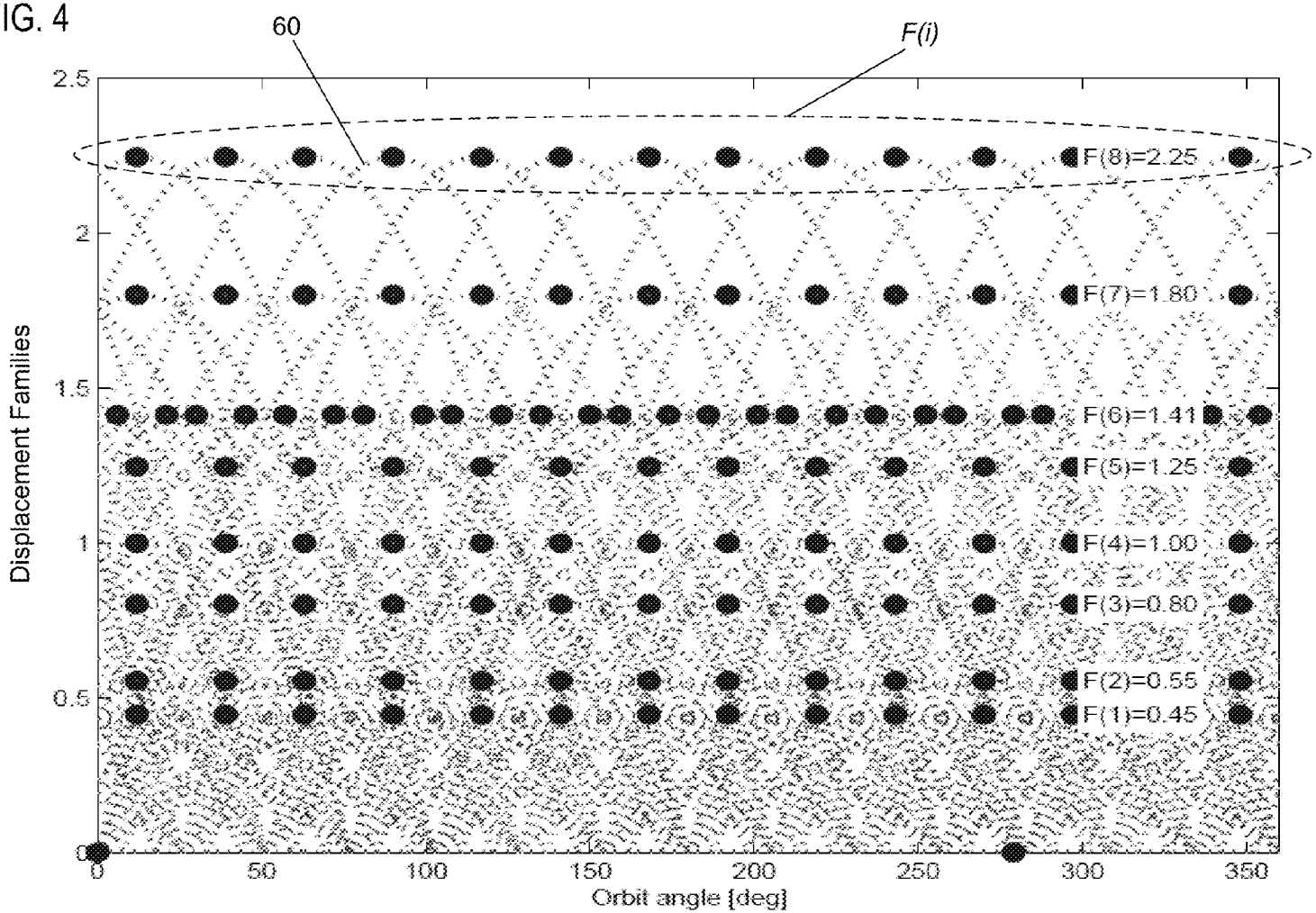
FIG. 4 is an exemplary graphical representation of displacement families.

Referring now to FIGS. 3 and 4, a mapping of displacement curves 60 (or torque curves 60 as instantaneous displacement D(t) is proportional to instantaneous torque $T_m$) for the displacement assembly 14 is shown. There are $2^N$ valve configurations, where N is the number of control valves 16. In the depicted embodiment of FIGS. 3 and 4, there are $2^7$ (=128) valve configurations $U_c$ since there are seven control valves 16 in fluid communication with seven volume chambers 22 and each control valve 16 is a two position control valve 16. For each of the valve configurations $U_c$, there is a corresponding displacement curve. In FIG. 3, displacement D is plotted with respect to the orbit angle $\beta$ for various valve configurations $U_c$.

In FIG. 4, the peak displacements of each of the displacement curves 60 are identified with a dark circle. As shown in FIG. 4, different valve configurations $U_c$ can generate the same or similar peak displacements. In the subject embodiment, there are nine distinct peak displacements, including zero. Each group of valve configurations $U_c$ that generate the same or similar peak displacements is collectively referred to as a displacement family F(i).

The complete set of displacement curves 60 is comprised of a much smaller set of displacement families F(i). For example, in the subject embodiment, a seven volume chamber fluid displacement assembly 14 has 128 displacement curves 60. However, out of the 128 displacement curves 60, there are nine displacement families F(i), where i=0, 1, 2, . . . , 8. The displacement families F(i) correspond to the nine distinct peak displacements.

Table 1 provides each of the displacement families F(i), the peak displacements for each of the displacement families F(i), and the valve configurations $U_c$ for each displacement family F(i). The peak displacement values in Table 1 have been normalized according to a case in which only a single volume chamber is pressurized. In other words, if only one chamber is pressurized, and the star member 20 is orbited 360°, the maximum instantaneous displacement is equal to 1. In one aspect of the present disclosure, the peak displacement values of the displacement families F(i) are monotonic.

Each valve configuration $U_c$ represents a $N_{j_c}$-bit binary number, where $N_{j_c}$, is equal to the number of control valves 16. In the subject embodiment, each valve configuration $U_c$ represents a seven-bit binary number. For example, the seven-bit binary number for valve configuration number "3" is equal to "0000011." This binary number indicates that volume chambers numbered six and seven are pressurized (i.e., in fluid communication with the fluid supply 36) while volume chambers numbered one through five are not pressurized (i.e., in fluid communication with the fluid return 38).

TABLE 1

| Displacement Family F(i) | Peak Displacement $D_p(F(i))$ | Valve Configuration $U_c$ |
|---|---|---|
| F(0) | 0 | 0 127 |
| F(1) | 0.445 | 34 17 68 91 109 18 110 118 36 55 59 93 9 72 |
| F(2) | 0.555 | 37 85 82 43 45 53 74 90 41 84 106 86 21 42 |
| F(3) | 0.802 | 73 19 25 38 89 51 100 102 108 27 76 77 50 54 |
| F(4) | 1 | 119 8 1 111 123 2 64 4 16 32 95 125 126 63 |
| F(5) | 1.247 | 107 33 20 80 87 122 5 47 94 10 40 61 66 117 |
| F(6) | 1.1412 | 29 49 78 98 44 75 52 83 105 22 39 69 116 11 58 70 88 13 35 57 81 92 101 114 26 46 23 104 |
| F(7) | 1.802 | 3 103 124 12 24 115 31 48 79 96 121 6 62 65 |
| F(8) | 2.247 | 28 99 67 60 71 97 7 14 30 56 113 120 112 15 |

The above discussion of the displacement families F(i) is based on the assumption that the displacement curve 60 for each of the valve configurations $U_c$ can be approximated as a sinusoidal profile. The displacement curve 60 can be approximated using the following equation (62):

$$\hat{D}(\beta,U_c)=D_p(U_c)\sin(\beta_0(U_c)-\beta), \tag{62}$$

where $\hat{D}(\beta,U_c)$ is an approximated displacement for an orbit angle β and a valve configuration $U_c$, $D_p(U_c)$ is the peak displacement of a valve configuration $U_c$, and $\beta_0(U_c)$ is the orbit angle where the displacement is equal to zero.

Figure 5:
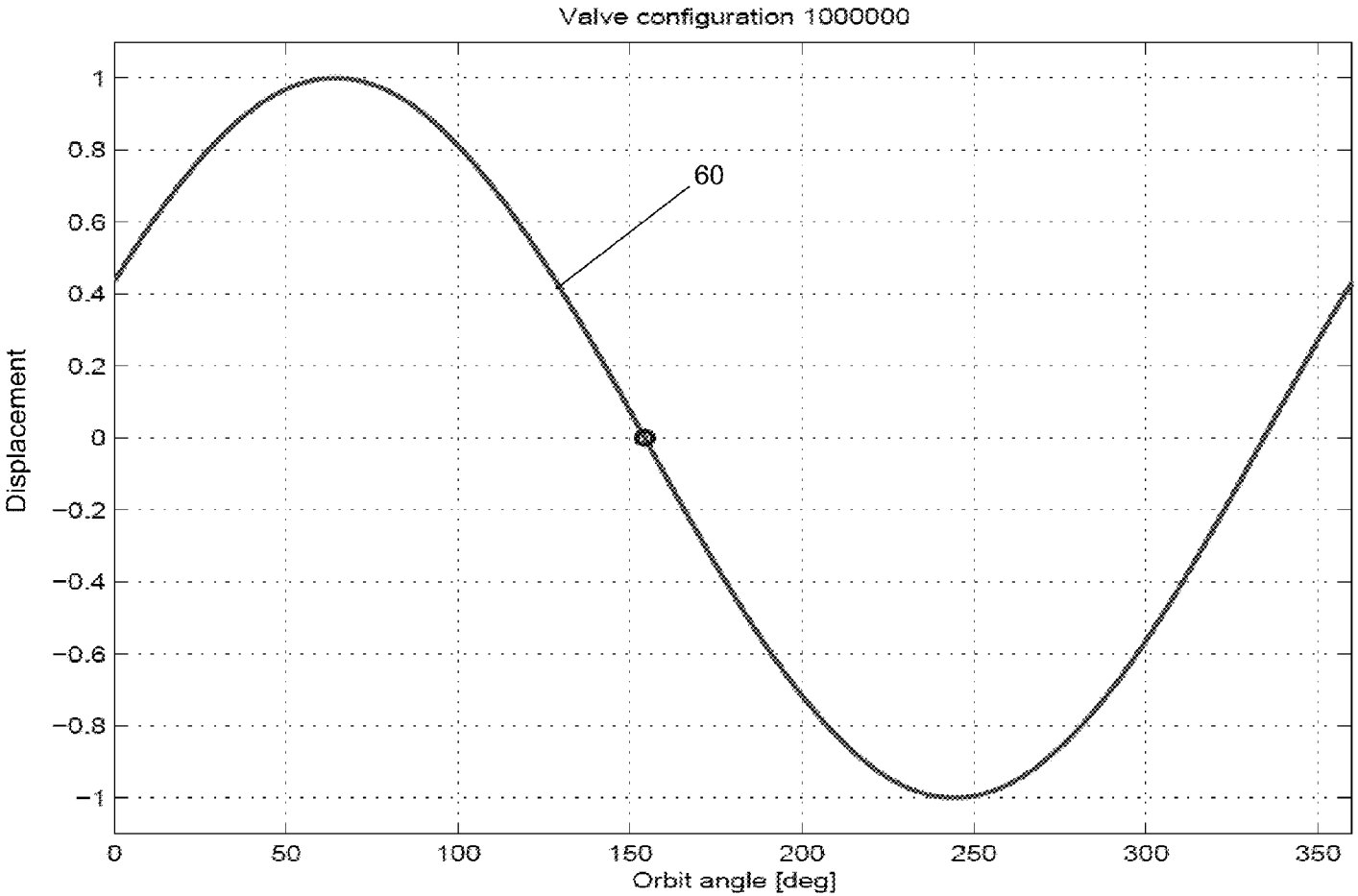
FIG. 5 is an exemplary plot of a displacement curve associated with a given valve configuration.

In FIG. 5, a displacement curve 60 with respect to the orbit angle β for valve configuration number "64," $U_c$="1000000"∈F(4), is shown. The peak displacement $D_p$ is normalized by the single chamber pressurization case. Therefore, $U_c$="1000000" and $D_p$=1. The orbit angle β corresponding to zero displacement is 154.29° and 334.29°. However, there is only one stable equilibrium point with the negative gradient. Hence, $\beta_0$=154.29°.

Figure 6:
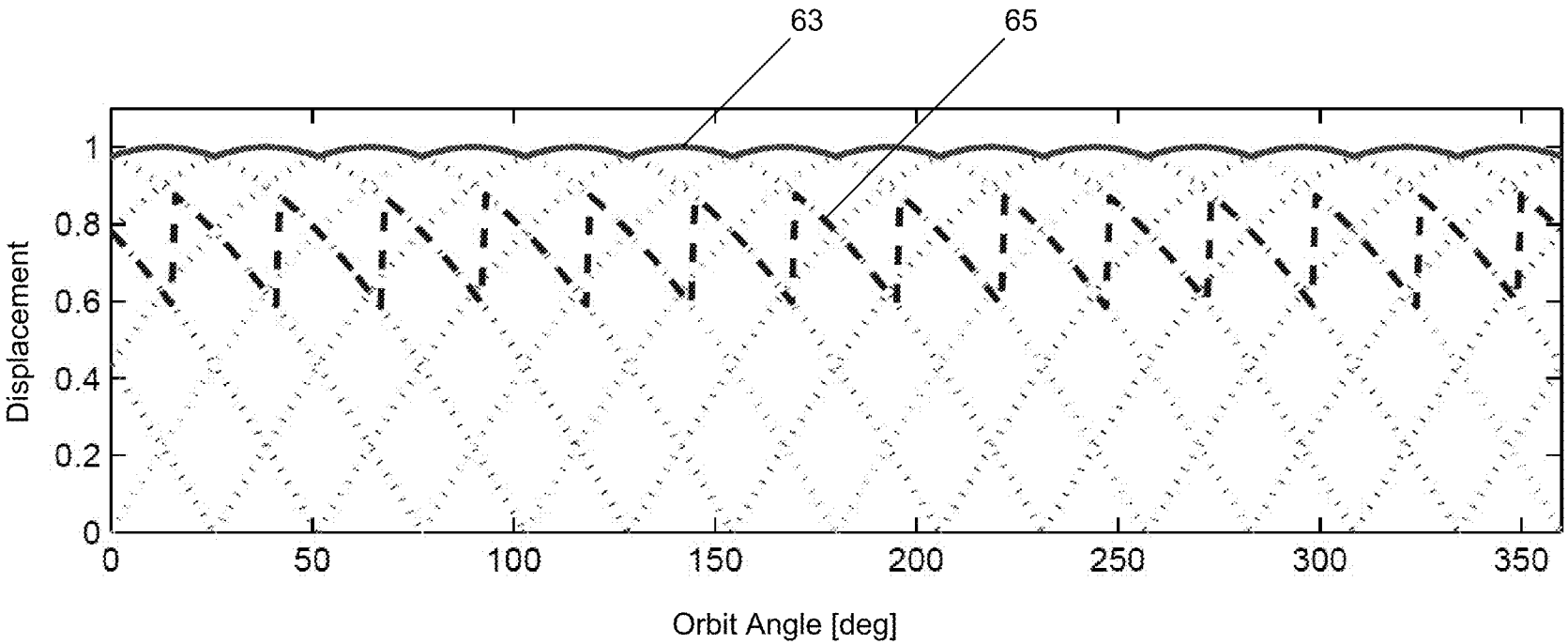
FIG. 6 is an exemplary plot of a peak displacement curve for a given displacement family associated with the fluid displacement assembly.
Figure 7:
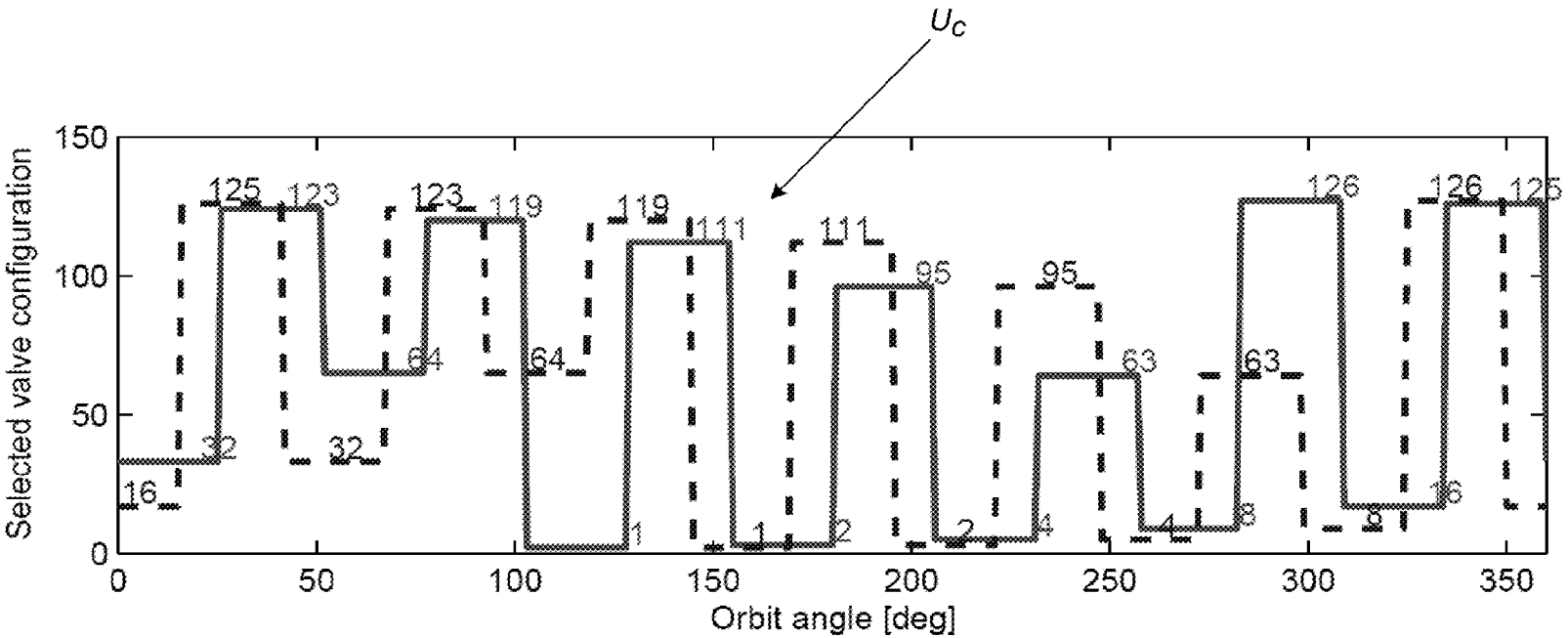
FIG. 7 is an exemplary plot of a valve configuration sequence used to generate the peak displacement curve of FIG. 6.

Referring now to FIGS. 6 and 7, phase shift will be described. With reference to equation 62, if $D_p$ is given by a displacement family F(i), the phase angle $\beta_0(U_c)-\beta$ needs to be shifted in order for the approximated displacement $\hat{D}(\beta, U_c)$ to equal the desired displacement $D_d$.

In FIG. 6, solid line represents an exemplary peak displacement curve 63 for displacement family F(4). In FIG. 6, the phase angle, $\beta_0(U_c)-\beta$, associated with the solid line peak displacement curve 63 is equal to 90°.

The solid line in FIG. 7 represents the sequence of valve configurations $U_c$ that correlates to the peak displacement curve in FIG. 6. In FIG. 7, the displacement curve for valve configuration number 32 is in the peak region, which is above the displacement curves of the rest of the valve configurations, for orbit angle β∈[0, 25.7°]. At β=25.7°, the displacement curve for valve configuration number 123 is in the peak region. Therefore, valve configuration number 123 takes over for valve configuration number 32. The transition from valve configuration number 32 to valve configuration number 123 occurs to maintain the maximum displacement. Similarly, at β=51.4°, the transition to valve configuration number 64 occurs since that displacement curve associated with valve configuration number 64 becomes dominant at that orbit angle β. In the subject embodiment, the transition interval from one valve configuration to another is 25.7° since there are 14 uniformly distributed valve configurations associated with displacement family F(4).

If the desired displacement $D_d$ is less than the peak displacement of the displacement family, a phase shift is introduced while maintaining the original valve configuration sequencing and the transition interval described above. Dashed line in FIG. 6 represents a shifted displacement curve 65 that occurs when the phase angle, $\beta_0(U_c)-\beta$, is shifted by 40° (i.e., $\beta_0(U_c)-\beta$=50°). As shown in FIG. 6, the average displacement of the shifted displacement curve 65 is about 75% of the peak displacement curve 63.

Figure 8:
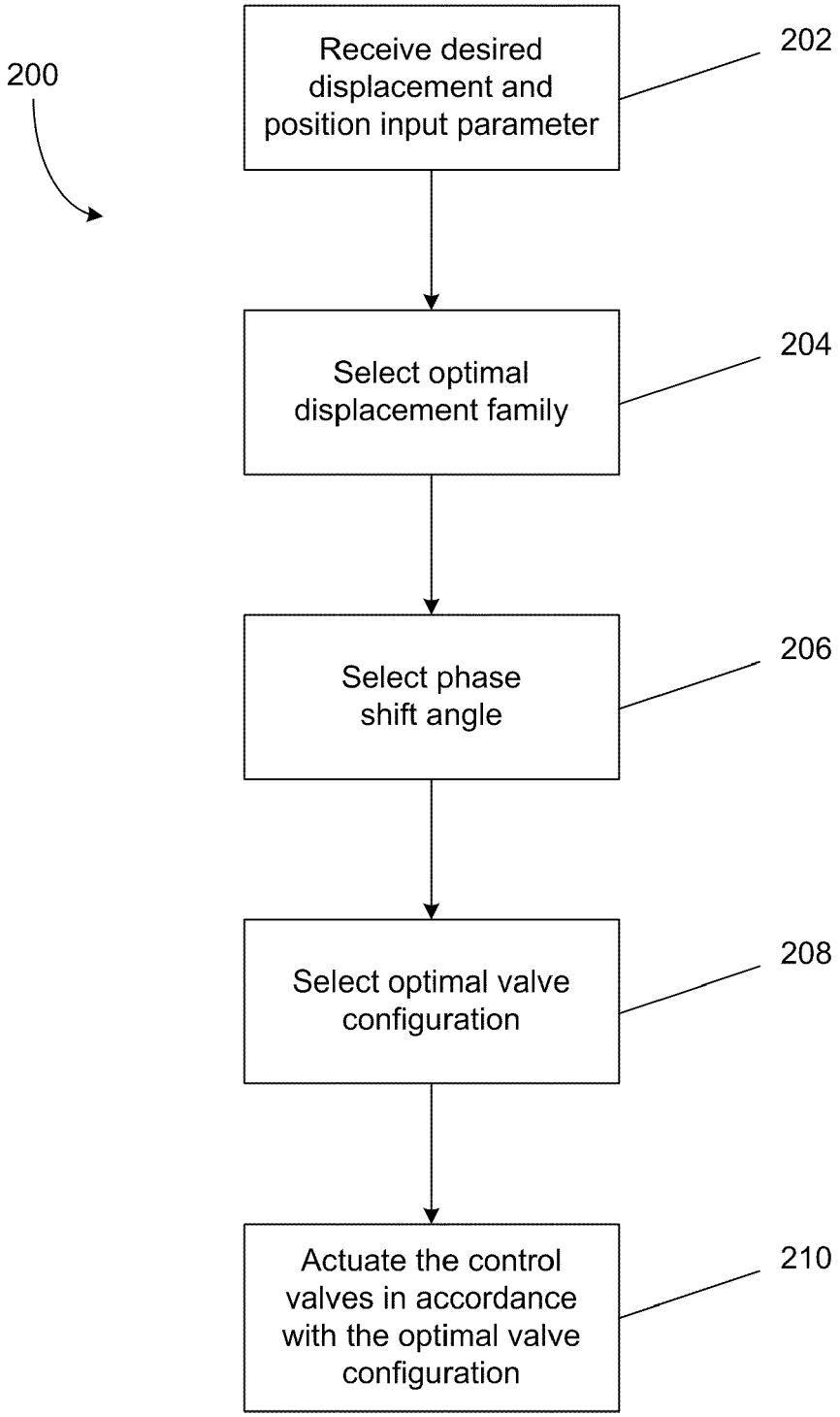
FIG. 8 is a representation of a method of multi-level phase shift control of the fluid displacement assembly.

Referring now to FIGS. 1, 4 and 8, a method 200 of multi-level phase shift control of the fluid displacement assembly 14 will be described. In step 202 of the method 200 of multi-level control, the ECU 43 receives the desired displacement $D_d$ and the position input parameter 48.

In step 204, a displacement family F(i) is selected based on the desired displacement $D_d$ and the position input parameter 48. As previously provided, the peak displacement values of the displacement families F(i) are monotonic. In other words, $D_p$ (F(i−1))<$D_p$(F(i)) for i=0, 1, 2, . . . , 8. As long as the desired displacement $D_d$ is less than the largest peak displacement of the displacement families F(i), the optimal displacement family F(k) can be identified.

To find the optimal displacement family F(k), the desired displacement $D_d$ is compared to the peak displacements of each of the displacement families F(i). This comparison continues until the desired displacement $D_d$ is less than the peak displacement of a second displacement family F(k) but greater than the peak displacement of a first displacement family F(k−1), which immediately precedes the second displacement family F(k). In this scenario, the optimal displacement family F(k) is the second displacement family F(k). In other words, given that $\|D_d\|\leqq D_p(F(8))$, k can be found so that $D_p(F(k-1))\leqq\|D_d\|\leqq D_p(F(k))$. Once k is determined, the optimal displacement family is F(k).

In step 206, a phase shift angle is selected. In one aspect of the present disclosure, the phase shift angle is selected by locating an optimal zero displacement angle $\beta_0$* in the optimal displacement family F(k). The optimal zero displacement angle $\beta_0$* can be calculated by the following equation 66:

$$\beta_0^* = \beta + \sin^{-1}\left(\frac{D_d}{D_p(F(k))}\right), \tag{66}$$

where $\beta_0$* is the optimal zero displacement angle among the valve configuration set of displacement family F(k), $D_d$ is the desired displacement, and $D_p$(F(k)) is the peak displacement for displacement family F(k). From equation 66, it can be seen that phase shift is implemented to cover both positive and negative displacement requests. For example, if $D_d$ is close to $D_p$(F(k)), then the optimal zero displacement angle $\beta_0$* would be approximately $\beta_0$*=β+90°. If $D_d$ is close to zero, then $\beta_0$*=β. If $D_d$ is close to −$D_p$(F(k)), then $\beta_0$*=β−90°.

Figure 9:
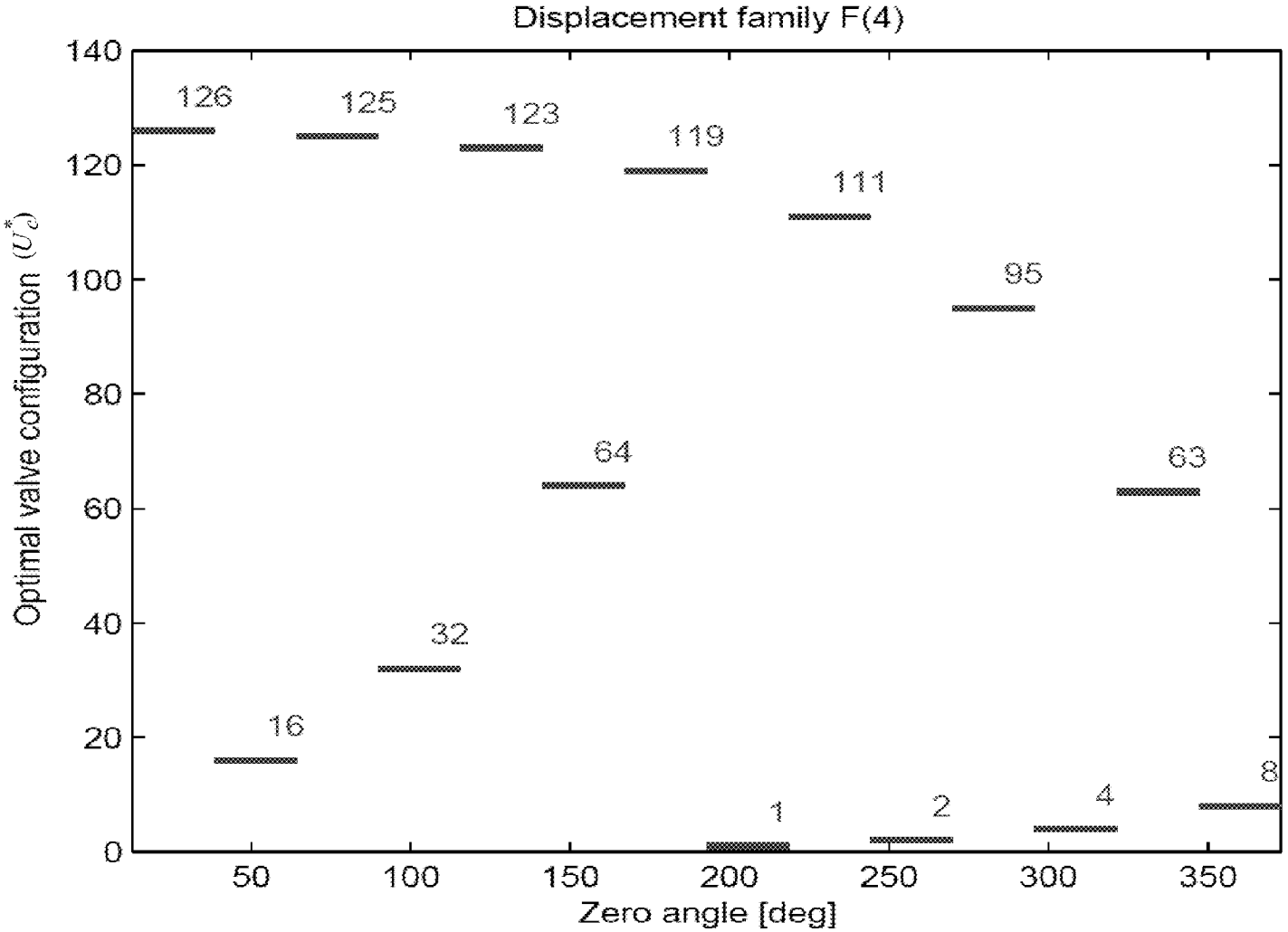
FIG. 9 is an exemplary plot of a mapping function for mapping a given zero displacement angle to a corresponding valve configuration.

In step 208, an optimal valve configuration $U_c$* is selected. The optimal valve configuration $U_c$* is selected based on the optimal zero displacement angle $\beta_0$* using the following mapping 68:

$$U_c^*=\beta_0^{-1}(\beta_0^*), \tag{68}$$

where $U_c$ is the optimal valve configuration, $\beta_0^{-1}(\bullet)$ is the mapping function for a given zero angle to a corresponding valve configuration $U_c$, and $\beta_0$* is the optimal zero displacement angle. An exemplary mapping function $\beta_0^{-1}(\bullet)$ for displacement family F(4) is shown in FIG. 9. In the depicted example of FIG. 9, the optimal valve configuration $U_c$* is shown on the y-axis while the optimal zero displacement angle $\beta_0$* is shown on the x-axis. By knowing the optimal zero displacement angle $\beta_0$*, the optimal valve configuration $U_c$* can be determined from the mapping function $\beta_0^{-1}(\bullet)$. For example, for $\beta_0 * \epsilon [141.44°, 167.14°]$, the optimal valve configuration $U_c$*=64.

In step 210 of the method 200, the control valves 16 are actuated in accordance with the optimal valve configuration $U_c$*.

Figure 10:
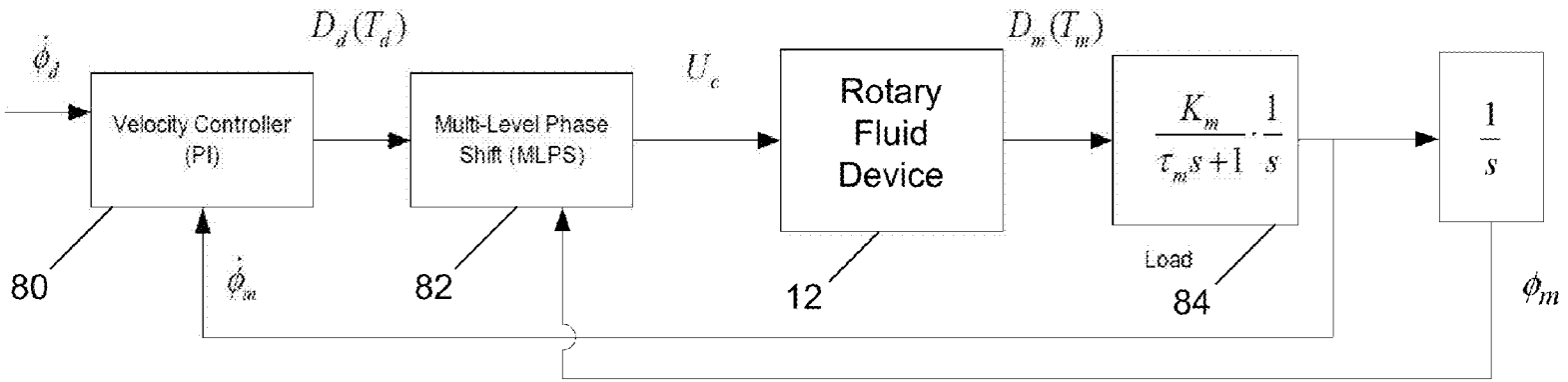
FIG. 10 is a schematic representation of a control system for a rotary fluid device suitable for use in the electro-hydraulic system of FIG. 1.

Referring now to FIG. 10, an exemplary control system for the rotary fluid device 12 is shown. The control system includes a velocity controller 80, a multi-level phase shift controller 82, the rotary fluid device 12, and a load 84.

The control system of FIG. 10 illustrates the use of rotary fluid device 12 as a motor. It will be understood, however, that the rotary fluid device 12 is not limited to use as a motor as it could also be used as a pump.

The velocity controller 80 is the outer loop in the control system. In one aspect of the present disclosure, the velocity controller 80 is a proportional-integral (PI) controller. The velocity controller 80 provides a desired displacement $D_d$ to an inner loop of the control system in response to desired speed $\dot{\phi}_d$ and actual speed $\dot{\phi}_m$ inputs. In one aspect of the present disclosure, the velocity controller 80 outputs the desired displacement $D_d$ to the multi-level phase shift controller 82.

The multi-level phase shift controller 82 receives the rotation angle $\phi_m$ of the star member 20 of the rotary fluid device 12 and transforms the desired displacement $D_d$ to a valve configuration $U_c$. In response to the valve configuration $U_c$, the ECU 43 drives a current amplifier to switch the control valves 16 to the desired polarity so that the corresponding volume chambers 22 of the fluid displacement assembly 14 of the rotary fluid device 12 are connected to either the fluid supply 36 or the fluid return 38. The rotary fluid device 12 outputs an actual displacement $D_m$ that acts on the load 84. The actual speed $\dot{\phi}_m$ of the rotary fluid device 12, which is affected by the load 84, is determined and compared against the desired speed $\dot{\phi}_d$ at the velocity controller 80.

Figure 11:
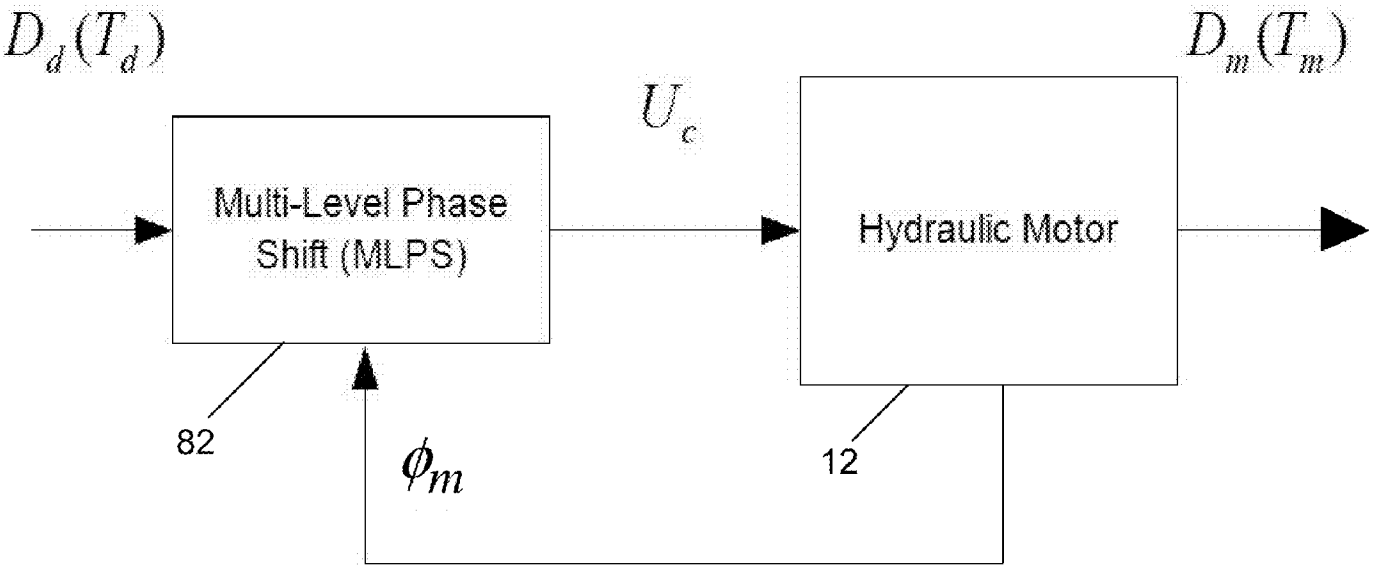
FIG. 11 is a semi-closed loop system identification diagram.

Referring now to FIG. 11, an exemplary semi-closed loop system identification diagram is shown. In one aspect of the present disclosure, the control valves 16 have a fast switching capability (e.g., <1 ms). As a result of this fast switching capability, the transfer function from the desired displacement $D_d$ to the actual displacement $D_m$ can be approximated to be unity, or $$\frac{D_m}{D_d} = 1.$$

Sinusoidal signals with a variety of frequencies are generated as a desired displacement. At the multi-level phase shift controller 82, the desired displacement $D_d$ is transferred as a sequence of valve configurations $U_c$ such that the actual displacement $D_m$ tracks the desired displacement $D_d$. Using the measured rotation velocity of the rotary fluid device 12, the parameters of the load transfer function $$\frac{\dot{\phi}}{D_m}$$

can be calibrated by assuming $$\frac{D_m}{D_d} = 1.$$

Figure 12:
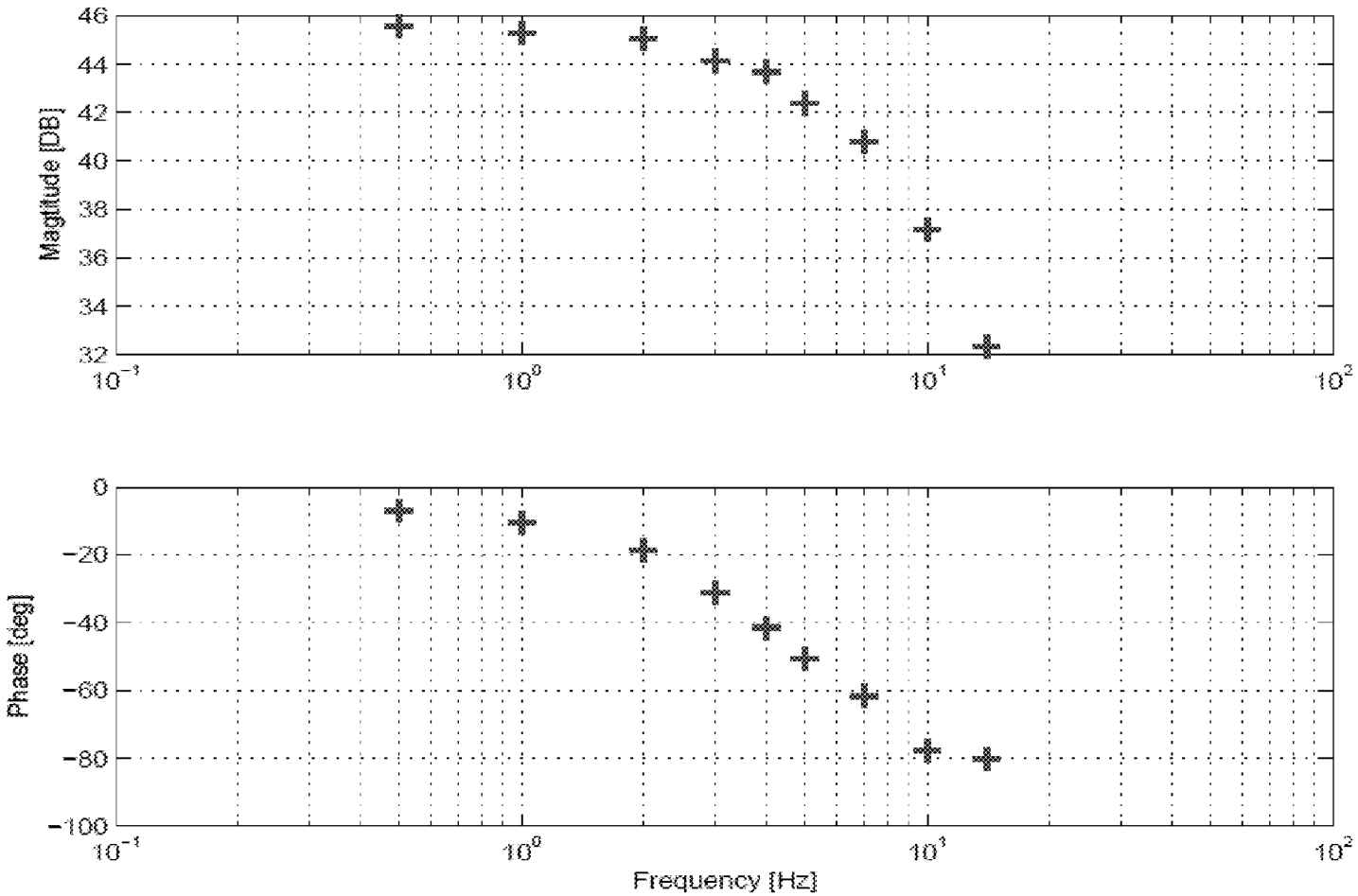
FIG. 12 is an exemplary Bode plot of the transfer function from $D_m$ to $\phi_m$.

Referring now to FIG. 12, an exemplary Bode plot of the transfer function from $D_m$ to $\dot{\phi}_m$ is shown. In the Bode plot of FIG. 12, an exemplary velocity response for $D_d$=0.8 sin(2πf), where f=0.5, 1, 2, 3, 4, 5, 7, 10, and 14 [Hz] is shown. For such a first order system, a time constant $$\tau_m = \frac{1}{8\pi} \text{ [1/rad]}$$

and a system gain $K_m$=19.8 [rad/sec].

In one aspect of the present disclosure, the velocity controller 80 has a proportional gain $K_p$ and an integrator gain $K_i$. The zero of the loop transfer function is $-K_i/K_p$. The poles are located at 0 and $-1/\tau_m$. The gain is $K_m K_p$. In one aspect of the present disclosure, root locus technology is used to determine the gains of the velocity controller 80. In one example, with the zero of the loop transfer function set at 1.1 times the non-zero pole and the closed loop system critically damped, $K_p$=0.084 while $K_i$=2.49.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A method for controlling a rotary fluid device comprising:

providing a rotary fluid device including:

a fluid displacement assembly including a first member and a second member, the first and second members having relative movement and cooperatively defining a plurality of volume chambers;

a plurality of control valves in fluid communication with the volume chambers;

receiving a desired displacement;

determining a relative position of the second member to the first member of the fluid displacement assembly;

selecting an optimal displacement family from a plurality of displacement families that is based on peak displacements of a plurality of displacement curves;

selecting a phase shift angle for the optimal displacement family so that an actual displacement of the fluid displacement assembly approaches the desired displacement; and actuating the control valves of the rotary fluid device in accordance with the phase shift angle.

2. The method of claim 1, wherein the fluid displacement assembly is a gerotor.

3. The method of claim 1, wherein the first member is a ring member having a plurality of rollers and the second member is a star member.

4. The method of claim 3, wherein the star member orbits and rotates relative to the ring member.

5. The method of claim 1, wherein an encoder is used to determine the relative position of the second member to the first member of the fluid displacement assembly.

6. The method of claim 1, further comprising selecting an optimal valve configuration based on the phase shift angle.

7. A method for controlling an electro-hydraulic system comprising:

providing an electro-hydraulic system including:

a rotary fluid device including:

a fluid displacement assembly including a first member and a second member, the first and second members having relative movement and defining a plurality of volume chambers;

a plurality of control valves in fluid communication with the volume chambers;

an electronic control unit in electrical communication with the plurality of control valves;

receiving a desired displacement;

determining a relative position of the second member to the first member of the fluid displacement assembly;

selecting an optimal displacement family from a plurality of displacement families that is based on peak displacements of a plurality of displacement curves;

selecting a phase shift angle of the optimal displacement family so that an actual displacement of the fluid displacement assembly approaches the desired displacement;

selecting an optimal valve configuration based on the phase shift angle; and actuating the control valves of the rotary fluid device in accordance with the optimal valve configuration.

8. The method of claim 7, wherein the fluid displacement assembly is a gerotor.

9. The method of claim 7, wherein the first member is a ring member having a plurality of rollers and the second member is a star member.

10. The method of claim 9, wherein the star member orbits and rotates relative to the ring member.

11. The method of claim 7, wherein the peak displacement of the optimal displacement family F(k) is greater than the desired displacement, which is greater than the peak displacement of an immediately preceding displacement family F(k–1).

12. The method of claim 7, wherein the phase shift angle is selected by locating an optimal zero displacement angle in the optimal displacement family.

13. The method of claim 12, wherein the optimal zero displacement angle is equal to $$\beta + \sin^{-1}\left(\frac{D_d}{D_p(F(k))}\right),$$

where β is the orbit angle of the second member relative to the first member, $D_d$ is the desired displacement, and $D_p(F(k))$ is the peak displacement for displacement family F(k).

14. A method for controlling a rotary fluid device comprising:

providing a rotary fluid device including:

a fluid displacement assembly including a ring member and a star member, the ring and star members having relative movement and defining a plurality of volume chambers;

a plurality of control valves in fluid communication with the volume chambers;

receiving a desired displacement;

determining a relative position of the star member to the ring member of the fluid displacement assembly;

selecting an optimal displacement family from a plurality of displacement families that is based on peak displacements of a plurality of displacement curves, the peak displacement of the optimal displacement family being greater than the desired displacement, which is greater than the peak displacement of an immediately preceding displacement family;

locating an optimal zero displacement angle in the optimal displacement family;

selecting an optimal valve configuration based on the optimal zero displacement angle; and actuating the control valves of the rotary fluid device in accordance with the optimal valve configuration.

15. The method of claim 14, wherein the star member orbits and rotates relative to the ring member.

16. The method of claim 14, wherein the optimal zero displacement angle is equal to $$\beta + \sin^{-1}\left(\frac{D_d}{D_p(F(k))}\right),$$

where β is an orbit angle of the star member relative to the ring member, $D_d$ is the desired displacement, and $D_p(F(k))$ is the peak displacement for displacement family F(k).

17. The method of claim 14, wherein each of the control valves is a two-position, three-way valve.

18. The method of claim 14, wherein the ring member includes a plurality of rollers.

19. The method of claim 14, wherein an encoder is used in the determination of relative position of the star member to the ring member of the fluid displacement assembly.

20. The method of claim 14, wherein the rotary fluid device is a motor.

* * * * *